United States Patent [19]

Havlick

[11] Patent Number: 4,669,989

[45] Date of Patent: Jun. 2, 1987

[54] NUN, CAN, AND DANGER BUOYS CONSTRUCTION

[75] Inventor: Richard S. Havlick, Gloversville, N.Y.

[73] Assignee: N. A. Taylor Co., Inc., Gloversville, N.Y.

[21] Appl. No.: 819,682

[22] Filed: Jan. 17, 1986

[51] Int. Cl.[4] ..... B63B 22/00

[52] U.S. Cl. ..... 441/1

[58] Field of Search ..... 441/1-3, 441/6-34; 114/230

[56] References Cited

U.S. PATENT DOCUMENTS

| | | | |
|---|---|---|---|
| D. 240,025 | 5/1976 | Curd, Jr. . | |
| 875,875 | 1/1908 | Willson | 441/28 |
| 2,110,596 | 3/1938 | Gaede | 441/16 |
| 2,553,798 | 5/1951 | Van Deventer | 441/28 |
| 3,397,413 | 8/1968 | Houtsma | 441/20 |
| 3,568,228 | 3/1971 | Rudelick | 441/28 |
| 3,694,837 | 10/1972 | Von Norring | 441/3 |
| 3,916,467 | 11/1975 | Curd, Jr. | 441/28 |
| 3,939,510 | 2/1976 | Curd, Jr. | 441/28 |

FOREIGN PATENT DOCUMENTS

| | | | |
|---|---|---|---|
| 1426638 | 3/1976 | United Kingdom | 441/1 |

*Primary Examiner*—Joseph F. Peters, Jr.
*Assistant Examiner*—Jesûs D. Sotelo
*Attorney, Agent, or Firm*—Nixon & Vanderhye

[57] ABSTRACT

Nun, can and danger buoys all have the same basic configuration. A central plastic pipe extends concentrically within an outer plastic shell. The outer plastic shell may be of one piece, or have a one piece bottom portion and a separable upper shell member. The outer plastic shell includes a first end portion which surrounds, and closes off, a first end of the pipe, and a counterweight is disposed interiorily of the pipe at its first end. The shell also includes an enlarged midportion which comprises a float and surrounds the pipe at a central portion of the pipe. When the outer plastic shell is of one piece construction, a second end portion extending opposite the first end portion may be shaped either as a tapered cone (and thus configures the buoy as a nun buoy) or may have a generally cylindrical configuration (and thus configured the buoy as a can or danger buoy). A collar surrounding the open second end of the pipe preferably holds the second end portion of the shell in place, and foam fills the interior of the outer shell. Alternatively, the outer shell may have the nun buoy configuration, and separate sleeves having can or danger buoy configurations may be slipped over the second end of the shell as desired. When the shell has a two piece construction, the upper shell member may be shaped, dimensioned and colored so as to configure the buoy as a nun, can or danger buoy.

22 Claims, 8 Drawing Figures

NUN, CAN, AND DANGER BUOYS CONSTRUCTION

BACKGROUND AND SUMMARY OF THE INVENTION

In most inland water ways, conventional buoys that are utilized are nun, can, and danger buoys. Such buoys may, or may not, be lighted. Wherever used, however, it is desirable to ensure that the buoys will resist fracture, puncture, or distortion even when struck by water craft, or when buffeted by waves along the shoreline. It is desirable to have the buoys be virtually unsinkable, yet simple to manufacture.

The buoys according to the present invention fulfill the desired criteria set forth above. Additionally, the buoys according to the present invention are constructed so that it is easy to make any type of buoy from the same basic component parts, and utilizing the same basic procedures. The buoys according to the present invention may simply and easily be made as nun, can, or danger buoys, and according to one aspect of the present invention may be converted from nun buoys to can or danger buoys after construction.

According to one aspect of the present invention, a buoy is provided which comprises: a central pipe having first and second ends; a one-piece outer plastic shell surrounding said pipe, and enclosing said first end of said pipe, said second end of said pipe being open; said outer shell having a first end portion surrounding said pipe first end; an enlarged mid portion, comprising a float spaced from said pipe; and an elongated second end portion, spaced from said pipe over the majority of the length thereof; foam disposed between said pipe and said outer shell; and a counterweight disposed in said pipe at said first end thereof. A collar preferably holds the second end of the outer plastic shell in contact with the central pipe. The collar and the pipe preferably are ABS plastic, while the outer shell is polyethylene and the foam is rigid urethane foam. To anchor the buoy, an eyebolt is provided which completely passes through the pipe and shell below the enlarged midportion of the shell, and above the counterweight. The second end portion of the shell may be tapered to configure the buoy as a nun buoy, and first and second plastic sleeves may be disposed over the second end portion of the shell to alternatively configure the buoy as a can buoy, or a danger buoy, respectively. A cap may be provided at the open second end of the pipe, or a conventional light source placed in association with the buoy at the open second end of the pipe.

According to another aspect of the present invention, a buoy is provided which comprises: a central plastic pipe having first and second means; a one piece outer plastic shell, said shell having a first, tubular, end portion surrounding and completely enclosing said pipe at said first end thereof; and an enlarged body portion, defining a float, surrounding said pipe at a midportion thereof; a counterweight disposed in said pipe at said first end thereof; an upper shell hollow member having interior cross-sectional dimensions larger than outer dimensions of said central pipe including a collar at a first end of said upper shell member, said collar having internal cross-sectional dimensions not significantly greater than exterior dimensions of said central pipe, and said upper shell member at a second end thereof, opposite said first end thereof, having cross-sectional dimensions significantly greater than outer cross-sectional dimensions of said pipe, but less than cross-sectional dimensions of said enlarged portion of said outer plastic shell; means for holding said upper shell member with said second end thereof operatively engaging said enlarged portion of said outer plastic shell, and said first end thereof operatively engaging said central pipe; and buoyancy means disposed between said enlarged portion of said outer plastic shell and said central plastic pipe.

It is the primary object of the present invention to provide a durable, effective, simple, versatile and relatively inexpensive buoy. This and other objects of the invention will become clear from an inspection of the detailed description of the invention from the appended claims.

DETAILED DESCRIPTION OF THE DRAWINGS

Figure 1:
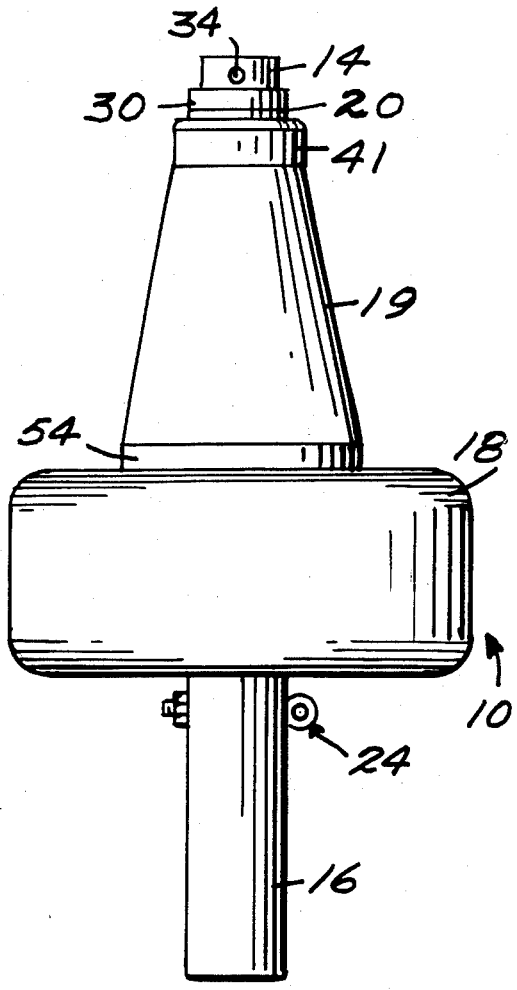
FIG. 1 is a side view of an exemplary nun buoy according to the present invention.
Figure 2:
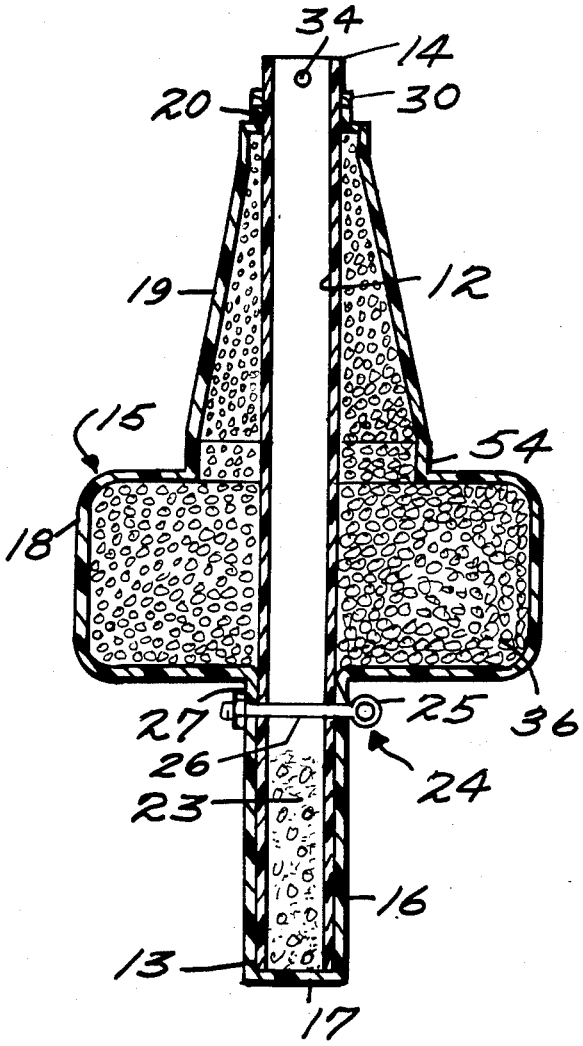
FIG. 2 is a longitudinal cross-sectional view of the buoy of FIG. 1.

An exemplary buoy according to the present invention is shown generally by reference numeral 10 in FIGS. 1 and 2. The buoy includes a central plastic (e.g., ABS) pipe 12 having a first end 13 and a second end 14. The pipe 12 is surrounded over a majority of the length thereof by a one piece plastic (e.g., polyethylene with UV #5 additive to prevent ultraviolet and general marine weathering, or like ultraviolet light degradation inhibitor) shell shown by general reference numeral 15. The outer plastic shell 15 includes a first end portion 16, including a terminal portion 17 thereof, which surrounds and closes of the first end 13 of the pipe 12. The shell 15 also comprising an enlarged midportion 18, comprising a float, and surrounding the pipe 12 at a midportion thereof. The shell 15 further comprises a second end portion 19, opposite the first end 16, the portion 19 being elongated and extending a substantial portion of the length of the pipe 12, but with the second end 14 of the pipe 12 extending past the top termination 20 of the second end portion 19.

The buoy 10 further comprising a counterweight 23 which is disposed interiorily of the pipe 12 at the first end 13 thereof. Preferably the counterweight (which may be concrete) is fastened to the pipe 12 as by adhesive, or any suitable conventional fastening mechanisms. Slightly below the float portion 18 of the buoy 10, an eyebolt, shown generally by reference numeral 24, is provided. The eyebolt 24 preferably is a galvanized, weldless, drop forged, steel eyebolt having an eye 25 of sufficient diameter to attach to a chain for mooring the buoy. The eyebolt 24 further comprises a shank portion 26 which passes completely through the first end 16 of the outer shell 15, and the central pipe 12, and is secured tightly with a galvanized washer and a nylon-lock galvanized steel nut 27. The eyebolt threads may be peened close to the nut to ensure against loosening.

Figure 3:
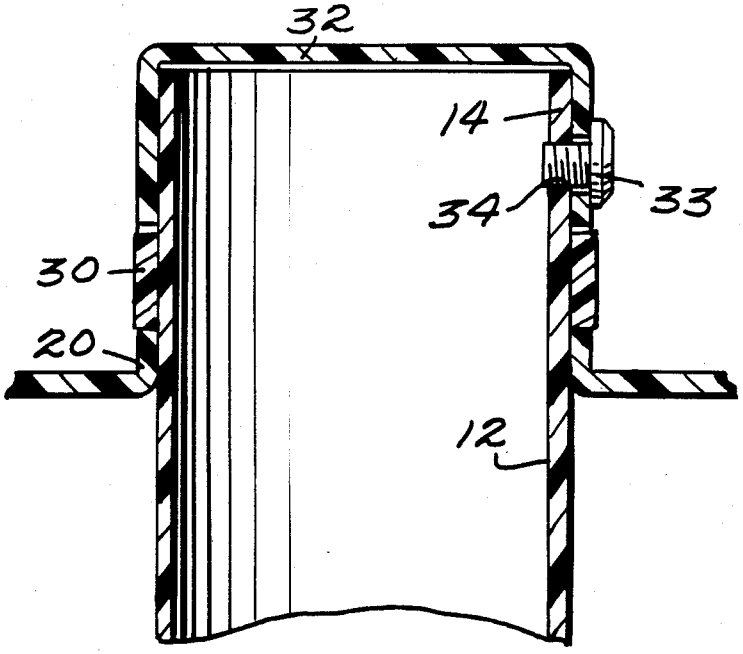
FIG. 3 is a longitudinal cross-sectional detailed view of the upper portion of the buoy of FIG. 1.

The buoy 10 further comprises means for stabilizing the upper portion 20 of the second end 19 of the shell 15, and such means preferably takes the form of a plastic (e.g., ABS) collar 30 which is securely attached (as by adhesive, ultrasonic welding, or the like) to the central pipe 12 and abuts the terminating portion 20 of the shell 15. As seen in FIG. 3, if a standard battery buoy light is not inserted into the open second end 14 of the pipe 12, then a plastic (e.g., polyethylene) cap 32 is placed over the open second end 14 of the pipe 12. As seen in FIG. 3, the cap 32 preferably is held in placed on the pipe 12 by a theft-proof bolt 33 which is in operative association with a tapped hole 34 formed adjacent the open second end 14 of the pipe 12.

In the embodiment of FIGS. 1 and 2, the second end portion 19 of the outer shell 15 has a generally tapered, conical shape, so that it configures the buoy 10 as a nun buoy. The second portion 19 of the buoy 10 typically would be colored red and may have red reflectorized sheeting as the top portion 41 thereof.

In a typical manner of constructing the buoy 10 of FIGS. 1 and 2, the outer shell 15 would be rotationally molded, and a central pipe 12 inserted in position with the first end 13 thereof surrounded enclosed by the first end 16, 17 of the shell 15. The counterweight 23 will have already been placed inside the pipe 12 at the first end 13 thereof, and affixed in place. Then collar 30 may be disposed over the open second end 14 of the pipe 12, to abut the termination 20 of the shell 15, and the collar 30 affixed in place on the pipe 12. Through one or more opening in the shell 15, foam (or like buoyancy means) will be injected into the interior of the shell 15, the foam—shown by reference numeral 36 in FIGS. 2—filing the volume between the outer shell 15 and the exterior of the pipe 12. Then the eyebolt 24 is put in place, the end 14 of the pipe 12 is either capped with cap 32 or a light is disposed in association therewith, and the buoy 10 is ready for use.

While any suitable buoyancy means may be utilized, it is preferred that the buoyancy means 36 be a ri9id urethane foam with a density of 2.0 pounds per cubic foot. The foam 36 locks the pipe 12 to the shell 15.

Figure 4:
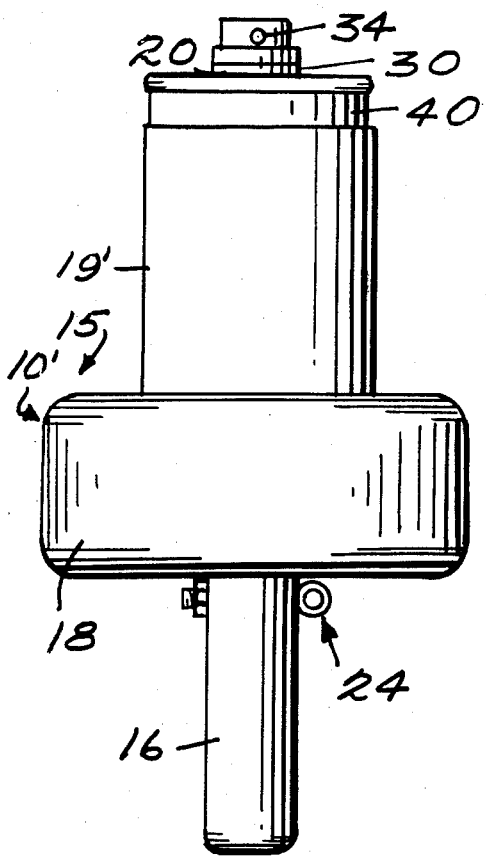
FIG. 4 is a side view of an exemplary can buoy according to the present invention.

The buoy 10' of FIG. 4 is basically the same as the buoy 10 of FIG. 1, and like structures are shown by the same reference numeral. However, in this case, the second (upper) portion of the shell, 19', is basically a cylinder having end terminating portion 20. The cylinder 19' thus configures the buoy as a can buoy. Typically, a can buoy would have a two inch wide reflective green band 40 adjacent to the top of the cylindrical second end 19' of the shell 15. The main body of the cylinder 19' also is preferably colored green.

Figure 5:
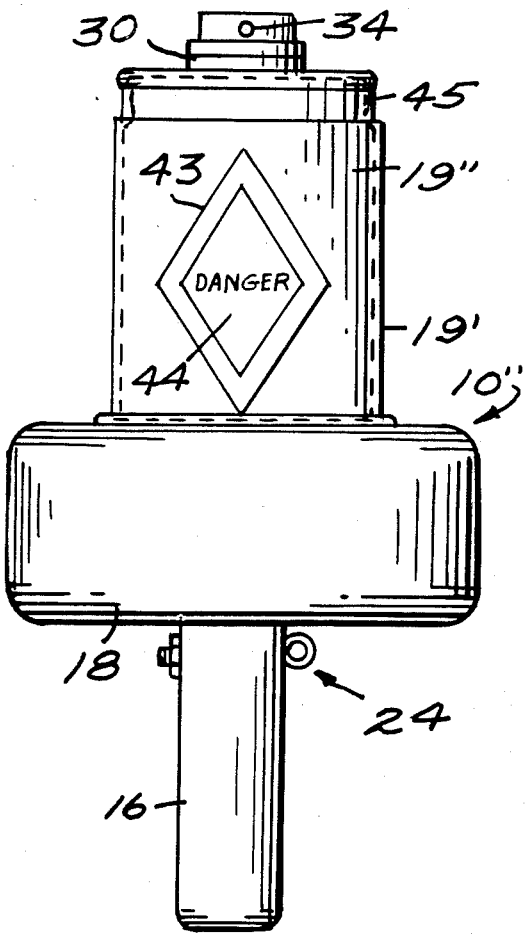
FIG. 5 is a side view of an exemplary danger buoy according to the present invention.

The buoy 10'' of FIG. 5 is the same as the buoy 10' of FIG. 4 except that a generally cylindrical plastic sleeve 19'' has been slipped over the second end portion 19' of the shell 15. The plastic sleeve 19'' has inner cross-sectional dimensions slightly greater than the outer cross-sectional dimensions of the portion 19' so that it may slide thereover and fit relatively tightly to it. If the fit is tight enough, an accessory component to hold the sleeve 19'' in place may not be necessary. If it is necessary, it may be in the form of an additional collar, cap or fastener, or like means acting between top of the sleeve 19'' and the pipe 12 or collar 30. The sleeve 19'' is dimensioned, and colored so that the buoy 10'' is configured as a danger buoy. As such, it is basically white plastic (e.g., polyethylene) with orange diamond shape symbols 43 on opposite sides thereof. The word danger is indicated by the reference numeral 44, and the upper strip 45 of orange reflective material is provided too.

If desired, all of the nun, can and danger buoys can be made from a single basic buoy configuration, namely that of FIGS. 1 and 2. For example, to transform the buoy 10 of FIGS. 1 and 2 to a can buoy, one may utilize a plastic (e.g., polyethylene) sleeve illustrated generally by reference numeral 50 in FIG. 6. The sleeve has a first open end 51 which has cross-sectional dimensions larger than the cross-sectional dimensions of the second end portion 19 of the buoy 10, but smaller than those of the mid portion 18. The second end 52 of the sleeve 50 is also open, but has a relatively small cross-sectional area, but large enough for the central pipe 12 (and perhaps collar 30) to pass therethrough. The sleeve 50 is merely inserted over the second end portion 19 of the shell 15 of the buoy 10. It may be held in place by any suitable means, such as an additional collar (like the collar 20), only having larger diameter, placed over the pipe 12 and abutting end 52 of the sleeve 50, and/or by $ frictional engagement between the interior surface of the sleeve 50 at end 51 and the portion 54 (see FIG. 2) of the shell 15 adjacent to midportion 18. Of course, a danger buoy may again be provided by slipping sleeve 19'' over the sleeve 50.

Figure 6:
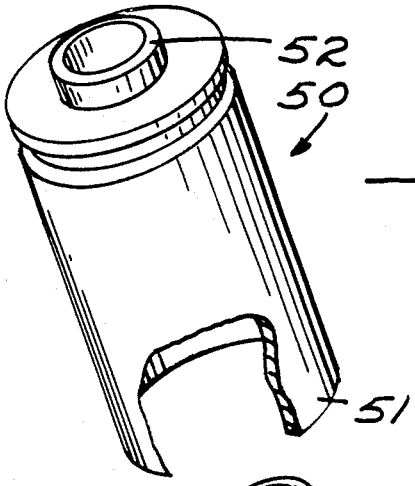
FIG. 6 is a perspective view, with portions of the outer shell cut away, of an upper shell member (providing a can or danger configuration)
Figure 7:
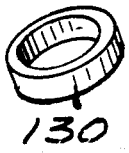
FIG. 7 is a perspective view, with portions cut away for clarity, of the main outer shell and central pipe of another form of exemplary buoy according to the present invention, utilizable with the outer shell member of FIG. 6 or 8.
Figure 8:
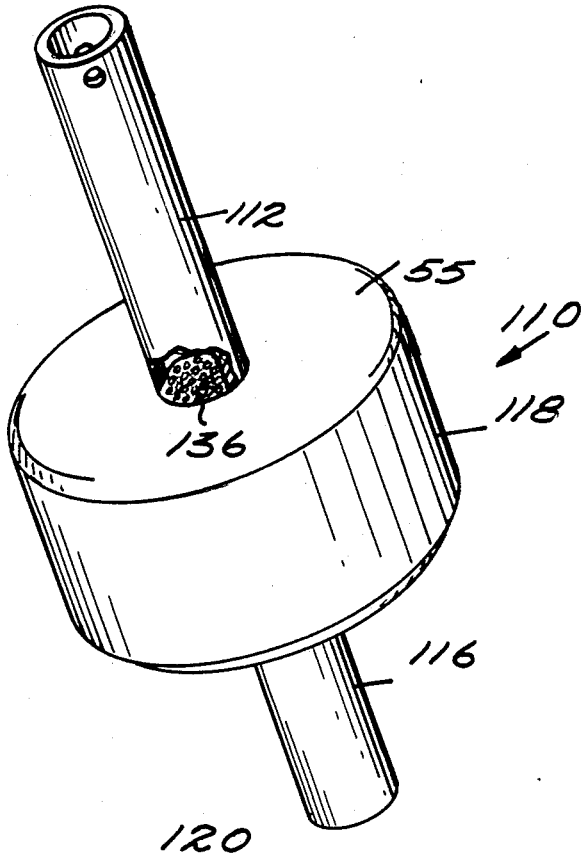
FIG. 8 is a perspective view, with portions cut away for clarity, like that of FIG. 6 only for an upper shell member designed to configure the buoy with which it is associated as a nun buoy.
Figure 8:
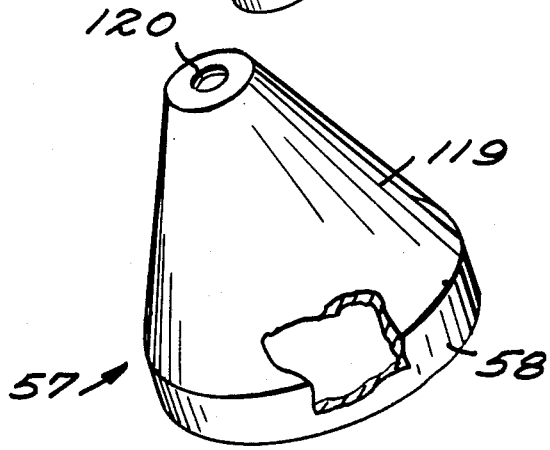

Another embodiment of the buoy according to the present invention may be seen with respect to FIGS. 6–8. In this embodiment, a one piece outer shell is not provided, but rather the outer shell is two pieces.

As seen in FIG. 7, the buoy 110 comprises a first end portion 116 and an enlarged main body 118 comprising a float. The central pipe 112 has a significant portion thereof $ extending outwardly from the top surface 55 of the portion 118. Note that the portion 118 is filled with foam 136, as can be seen in FIG. 7 where the pipe 112 has been cut away for clarity of illustration. Other components of the buoy 110, such as the counterweight, eyebolt, etc., are the same as in the other embodiments.

After construction of what is illustrated in FIG. 7, the buoy 110 is completed by either disposing a sleeve such as the sleeve 50 shown in $ FIG. 6 in operative association therewith, or the sleeve 57 illustrated in FIG. 8. When the sleeve 50 is slid over the pipe 112, concentric therewith, it is held in place at the top thereof with the plastic ring 130, which is ultrasonically welded, or otherwise attached to the pipe 112 abutting the end 52 of the sleeve 50. If desired, the sleeve 50 also may be secured to the surface 55 of the float portion 118., If it is desired to make the structure of FIG. 7 into a nun buoy instead of a can or danger buoy, than the upper shell member 57 in FIG. 8 is utilized. This upper shell member 57 includes a generally conical main body portion 119 having a first open end 58 and a second open end 120. The upper shell 57 is placed into operative association with the pipe 112 and surface 55 in the same manner that the sleeve 50 was, and it too may be held in place utilizing collar 130.

It will thus be seen that according to the present invention a simple, effective, durable, and versatile buoy has been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A buoy comprising:

a central pipe having first and second ends;

a one-piece outer plastic shell having a first end portion surrounding said pipe, and enclosing said first end of said pipe, said second end of said pipe being open;

said outer shell having an enlarged mid portion, comprising a float spaced from said pipe; and an elongated second end portion, spaced from said pipe over the majority of the length of said second end portion;

foam disposed between said pipe and said outer shell; and a counterweight disposed in said pipe at said first end thereof.

2. A buoy as recited in claim 1 further comprising a collar having an inside diameter larger than the outside diameter of said central pipe, said collar surounding said central pine at said second end thereof and abutting said second end portion of said outer shell, said collar secured to said pipe.

3. A buoy as recited in claim 2 wherein said central pipe and said collar are plastic.

4. A buoy as recited in claim 3 wherein said pipe and said collar are ABS plastic, and wherein said outer shell is polyethylene including ultraviolet light degradation inhibitors.

5. A buoy as recited in claim 4 wherein said foam is rigid urethane foam.

6. A buoy as recited in claim 2 further comprising a cap disposed over the second end of said pipe, said collar disposed between said cap and said outer shell, said cap connected to said pipe by a screw threaded fastener.

7. A buoy as recited in claim 1 further comprising and eyebolt extending completely through said outer shell on said pipe, said eyebolt disposed between said couterweight and said shell midportion.

8. A buoy as recited in claim 1 wherein said second end portion of said outer shell has a decreasing taper from the portion thereof adjacent to said shell enlarged mid portion, to a terminating portion thereof remote from said midportion, so that said second portion of said outer shell configures said buoy as a nun buoy.

9. A buoy as recited in claim 8 further comprising a first plastic sleeve, said sleeve having larger inside cross-sectional dimensions than the largest outside cross-sectional dimensions of said outer shell second end, but smaller than the cross-sectional dimensions of said outer shell enlarged mid portion, said first plastic sleeve disposed over said outer shell second end portion and operatively affixed to said central pipe adjacent to said second end of said central pipe.

10. A buoy as recited in claim 9 wherein said first plastic sleeve configures the buoy as a can buoy.

11. A buoy as recited in claim 11 further comprising a second plastic sleeve having internal cross-sectional dimensions larger than the largest exterior cross-sectional dimensions of said first plastic sleeve, but smaller than the cross-sectional dimensions of said enlarged mid portion of said outer shell; said second plastic sleeve disposed over said first plastic sleeve.

12. A buoy as recited in claim 11 wherein said a second plastic sleeve configures the buoy as a danger buoy.

13. A buoy as recited in claim 1 wherein said counterweight is secured to the interior of said central pipe at said first end thereof.

14. A buoy as recited in claim 1 further comprising an exterior cap disposed over the open second end of said pipe, and connected to said pipe by a threaded fastener.

15. A buoy comprising:

an outer plastic shell having an enlarged portion comprising a float, and having an elongated upper portion, said elongated upper portion concentric with said enlarged portion, and tapering from a largest exterior cross-sectional area at said enlarged portion, to a smaller cross-sectional area at an end thereof remote from said enlarged portion; said elongated upper portion configuring the buoy as a nun buoy;

a first plastic sleeve having interior cross-sectional dimensions larger than the largest exterior cross-sectional dimension of said elongated upper portion of said outer plastic shell, but having a cross-sectional area smaller than the cross-sectional area of said enlarged portion of said outer plastic shell; said first plastic sleeve having a generally cylindrical configuration and, when disposed over said upper portion of said outer plastic shell concentric therewith, configuring the buoy as a can or danger buoy;

means for maintaining said plastic shell in a surrounding concentric relationship with said outer plastic shell upper portion when said plastic sleeve is disposed over said upper portion of said outer plastic shell; and buoyancy means disposed within said outer plastic shell for making the buoy buoyant.

16. A buoy as recited in claim 15 further comprising a second plastic sleeve, said second plastic sleeve having interior cross-sectional dimensions slightly greater than the exterior cross-sectional dimensions of said first plastic sleeve, but smaller than the cross-sectional dimensions of said enlarged portion of said outer plastic shell; said second plastic sleeve adapted to be disposed over, and concentric with, said first plastic sleeve and held in operative engagement with said first plastic sleeve; said first plastic sleeve dimensioned and colored so as to configure the buoy as a can buoy, and said second plastic sleeve being dimensioned and colored so as to configure the buoy as a danger buoy.

17. A buoy as recited in claim 15 wherein said buoyancy means comprises buoyant material; and further comprising a central plastic pipe disposed at the center of said outer plastic shell, said buoyant material disposed between said central plastic pipe and said outer plastic shell; said central plastic pipe having an end thereof extending outwardly past the end of said outer plastic shell upper section remote from said enlarged portion; and wherein said means for maintaining said first plastic sleeve in operative association with said outer plastic shell upper portion includes means for acting between said central pipe and said first plastic sleeve.

18. A buoy comprising:

a central plastic pipe having first and second ends;

a one piece outer plastic shell, said shell having a first, tubular, end portion surrounding and completely enclosing said pipe at said first end thereof; and an enlarged body portion, defining a float, surrounding said pipe at a midportion thereof;

a counterweight disposed in said pipe at said first end thereof;

an upper shell hollow member having interior cross-sectional dimensions larger than outer dimensions of said central pipe including a collar at a first end of said upper shell member, said collar having internal cross-sectional dimensions not significantly greater than the exterior dimensions of said central pipe, and said upper shell member at a second end thereof, opposite said first end thereof, having cross-sectional dimensions significantly greater than the outer cross-sectional dimensions of said pipe, but less than the cross-sectional dimensions of said enlarged portion of said outer plastic shell;

means for holding said upper shell member with said second end thereof operatively engaging said enlarged portion of said outer plastic shell, and said collar operatively engaging said central pipe with said second end of said central pipe extending past said collar; and buoyancy means disposed between said enlarged portion of said outer plastic shell and said central plastic pipe.

19. A buoy as recited in claim 18 wherein said upper shell member has shape, dimensions, and coloring so that when in operative association with said outer plastic shell it configures said buoy as a nun buoy.

20. A buoy as recited in claim 18 further comprising an eyebolt extending completely through said outer shell and said pipe, said eyebolt disposed between said counter weight and said shell body portion.

21. A buoy as recited in claim 18 wherein said upper shell has dimensions, shape, and coloring so that when in operative association with said outer plastic shell, it configures said buoy as a can buoy.

22. A buoy as recited in claim 18 wherein said upper shell has shape, dimensions, and coloring so that when it is in operative association with said outer plastic shell it configures said buoy as a danger buoy.

* * * * *